US012435937B2

(12) United States Patent
Ehrlich et al.

(10) Patent No.: US 12,435,937 B2
(45) Date of Patent: Oct. 7, 2025

(54) FIREARM TRIGGER CONTROL DEVICE

(71) Applicant: SMART SHOOTER LTD., Yagur (IL)

(72) Inventors: Avshalom Ehrlich, Kibbutz Ramat Hashofet (IL); Zahi Giladi, Kibbutz Ramat David (IL)

(73) Assignee: SMART SHOOTER LTD., Yagur (IL)

( * ) Notice: Subject to any disclaimer, the term of this patent is extended or adjusted under 35 U.S.C. 154(b) by 17 days.

(21) Appl. No.: 18/290,277

(22) PCT Filed: May 9, 2022

(86) PCT No.: PCT/IL2022/050481

§ 371 (c)(1),
(2) Date: Nov. 10, 2023

(87) PCT Pub. No.: WO2022/238997

PCT Pub. Date: Nov. 17, 2022

(65) Prior Publication Data

US 2024/0240894 A1 Jul. 18, 2024

(30) Foreign Application Priority Data

May 10, 2021 (IL) ..... 283081

(51) Int. Cl.

| | |
|---|---|
| ***F41A 17/46*** | (2006.01) |
| ***F41A 17/06*** | (2006.01) |
| ***F41A 17/08*** | (2006.01) |
| ***F41A 17/22*** | (2006.01) |
| ***F41G 3/14*** | (2006.01) |

(52) U.S. Cl.

CPC ..... *F41A 17/46* (2013.01); *F41A 17/06* (2013.01); *F41A 17/08* (2013.01); *F41A 17/22* (2013.01); *F41G 3/14* (2013.01)

(58) Field of Classification Search

CPC ..... F41A 17/46; F41A 17/06; F41A 17/08; F41A 17/22; F41G 3/14

See application file for complete search history.

(56) References Cited

U.S. PATENT DOCUMENTS

| | | | | |
|---|---|---|---|---|
| 5,448,847 A | | 9/1995 | Teetzel | |
| 5,966,859 A | * | 10/1999 | Samuels | F41G 3/12 42/70.11 |
| 6,142,137 A | * | 11/2000 | MacLaughlin | F41B 11/62 124/32 |
| 6,412,207 B1 | * | 7/2002 | Crye | F41A 17/02 42/70.08 |
| 8,234,969 B2 | | 8/2012 | Beckmann | |
| 9,557,129 B2 | | 1/2017 | Lupher et al. | |

(Continued)

FOREIGN PATENT DOCUMENTS

| | | |
|---|---|---|
| CN | 110207537 A | 9/2019 |
| EP | 2613117 A2 | 7/2013 |
| RU | 2184336 C2 | 6/2002 |

OTHER PUBLICATIONS

PCT International Search Report and Written Opinion, PCT Application No. PCT/IL2022/050481, Jul. 5, 2022, 10 pages.

*Primary Examiner* — Joshua E Freeman
(74) *Attorney, Agent, or Firm* — Fenwick & West LLP

(57) ABSTRACT

A firearm trigger control device, which is adapted to control the displacement of a firearm's trigger, such as to enable the discharge of a projectile upon receiving a firing signal (e.g., at a timing determined as optimal for hitting a designated target).

17 Claims, 7 Drawing Sheets

(56) References Cited

U.S. PATENT DOCUMENTS

| | | | | |
|---|---|---|---|---|
| 9,658,017 | B2 | 5/2017 | Alicea | |
| 9,863,731 | B1 * | 1/2018 | Alderman | F41A 19/58 |
| 10,126,080 | B2 | 11/2018 | Martin | |
| 10,240,881 | B1 | 3/2019 | Galie et al. | |
| 10,996,026 | B1 * | 5/2021 | Sitrick | G06V 10/764 |
| 2005/0121014 | A1 | 6/2005 | Monks et al. | |
| 2007/0186457 | A1 * | 8/2007 | Pitt | F41A 17/46 124/40 |
| 2009/0158922 | A1 * | 6/2009 | Werner | F41A 19/59 89/136 |
| 2011/0173869 | A1 | 7/2011 | Uhm | |
| 2013/0145670 | A1 * | 6/2013 | Kuhlman | F41A 19/59 42/84 |
| 2013/0180147 | A1 | 7/2013 | Lupher et al. | |
| 2014/0028856 | A1 * | 1/2014 | Ehrlich | F41G 3/08 348/169 |
| 2014/0182179 | A1 | 7/2014 | McHale | |
| 2014/0184788 | A1 | 7/2014 | McHale et al. | |
| 2015/0253093 | A1 * | 9/2015 | Allan | F41A 17/06 42/70.06 |
| 2015/0267992 | A1 * | 9/2015 | Alderman | F41A 19/09 42/90 |
| 2015/0345887 | A1 * | 12/2015 | Shneorson | F41A 19/59 89/28.1 |
| 2016/0061549 | A1 | 3/2016 | Patterson et al. | |
| 2017/0227315 | A1 * | 8/2017 | Milde, Jr. | F41A 17/063 |
| 2018/0087860 | A1 | 3/2018 | Sullivan et al. | |
| 2019/0226791 | A1 | 7/2019 | Baxter | |
| 2019/0346226 | A1 | 11/2019 | Shneorson et al. | |
| 2020/0182576 | A1 * | 6/2020 | Itzhakian | F41A 35/00 |
| 2021/0088298 | A1 | 3/2021 | Black et al. | |
| 2021/0140733 | A1 * | 5/2021 | Herskowitz | F41G 3/08 |
| 2022/0357123 | A1 * | 11/2022 | Prudent | F41A 19/58 |

* cited by examiner

FIREARM TRIGGER CONTROL DEVICE

FIELD OF THE INVENTION

The present invention is in the field of firearms. More specifically, the invention relates to a firearm trigger control device.

BACKGROUND OF THE INVENTION

Effective use of firearms is an enduring challenge for epochs, occupying many professional shooting trainers, firearms engineers, and firearms users, investing vast efforts in improving the training methods and shooting practice, enhancing the firearms' structure for stable grip before and during shooting, for releasing bullets in an optimal trajectory, and for optimal aiming thereof towards a desirable target.

Furthermore, enhanced aiming aids are widely used for improving the users' aiming accuracy, such as advanced optical scopes/sights. In recent years, smart aiming systems have been introduced to firearms (e.g., smart sights that include digital displays and computer-controlled aiming points that may consider targets' range, wind correction, users' movements, etc.).

However, while precise aiming is essential for effective shooting, an equally critical parameter affecting the shooting results is the optimal bullet discharge timing (i.e., at the required aiming direction) in which hitting the designated target is at the highest probability.

A man-operated firearm's discharge mechanism is usually controlled by a user's finger gradually pressing the firearm's trigger in a squeezing (i.e., naturally non-linear) manner, while a projectile is discharged in a very specific moment, for example, when the sear is released.

Hence, a firearm user can know when the firearm is pointed at the desired target when using enhanced aiming. Yet, it is challenging for a trained firearm operator to discharge a bullet at the optimal moment for effectively hitting the designated target. This is especially true when the user is in an actual combat situation where he is often fatigued and under heavy stress, usually causing an unstable barrel position. Additionally, the target might also be moving, making the bullet discharge timing even more challenging for the user.

Therefore, it is an object of the present invention to provide a firearm trigger control device that enables to trigger the discharge of a bullet in a controlled manner at a determined time.

It is another object of the present invention to provide a firearm trigger control device, with which existing firearms can be retrofitted with minimal or no modifications required.

Other objects and advantages of the invention will become apparent as the description proceeds.

SUMMARY OF THE INVENTION

A firearm trigger control device is adapted to control the displacement of a firearm's trigger to enable the discharge of a projectile upon receiving a firing signal (i.e., to release the "shots" accurately). According to an embodiment of the invention, the device restricts the trigger's displacement to a predetermined extent and, upon receiving the firing signal, releases the trigger, to complete the displacement, thereby triggering a projectile discharged from the firearm at a timing that is determined by the firing signal as optimal for hitting a designated target.

In one aspect, the firearm trigger control device comprises a trigger travel limiter, and a corresponding actuation means (e.g., a trigger traveler limiter actuator), wherein the actuation means drives/causes the trigger travel limiter to restrict the trigger's displacement to a predetermined extent or to release the trigger (e.g., upon receiving the firing signal).

In another aspect, the device comprises a microcontroller that controls the actuation means being in a closed relationship with the trigger travel limiter to control its motion with respect to a firearm's trigger, such as to restrict its displacement to a predetermined extent and release it, at a timing determined as optimal upon receiving the firing signal, to complete its displacement and thus trigger a projectile discharged from the firearm.

In yet another aspect, the optimal timing is determined by a firing signal received from an external source. For example, the external source can be a smart aiming system configured to provide a firing signal when the hit probability of the target is high enough.

According to an embodiment of the invention, the actuation means comprises an actuator selected from the group consisting of: an electromagnetic actuator, hydraulic actuator, pneumatic actuator, solenoid actuator, piezoelectric actuator, or a combination thereof.

According to another aspect, the actuation means is a rotatable camshaft actuator having variating radial protrusions and depressions being controllably rotated by a motor.

In a further aspect, the trigger travel limiter interfaces with the firearm's trigger. According to an embodiment of the invention, the trigger travel limiter comprises a blocking element (e.g., that can be in the form of a pin) that is adapted to interface the rear portion of the firearm's trigger.

In another aspect, the trigger travel limiter comprises a bearing hinged to its rear portion, wherein said bearing is in a rolling interface with the actuation means.

According to an embodiment of the invention, the device further comprises one or more sensors attached to one or more of its components. For example, the one or more sensors can be selected from the group consisting of: hall sensors, gyroscope sensors, acceleration sensors, pressure sensors, or any combination thereof.

According to an embodiment of the invention, the device is installed in such a way that the blocking element is activated from the rear side of the trigger. For example, the device can be installed within an existing firearm grip handle, within a dedicated grip handle—replacing the firearm's original grip handle, or it can be provided as a built-in module integrated with a new firearm.

According to another embodiment of the invention, the device is installed in such a way that the blocking element is activated from the front side of the trigger. For example, the device may be installed in front of the firearm's trigger, while the blocking element is configured to interface with the rear side of the trigger.

In another aspect, the device further comprises a controller that may utilize data from the sensors to acquire the desired direction of fire and to provide a firing signal based on the optimal timing for discharging a projectile toward a target.

In yet another aspect, the device is adapted to detect an initial press on the firearm's trigger for determining the desired direction of fire.

In a further aspect, the device further comprises a controller configured to control the actuation means of the trigger travel based on the received firing signal of the external source.

In still a further aspect, the device further comprises sensors suitable for providing data in accordance with the usage or state of the firearm, wherein said sensors are used for one or more of the following: maintenance, safety, control, shot counting, and malfunction identification purposes.

BRIEF DESCRIPTION OF THE DRAWINGS

The above and other characteristics and advantages of the invention will be better understood through the following illustrative and non-limitative detailed description of preferred embodiments thereof, with reference to the appended drawings, wherein.

A DETAILED DESCRIPTION OF THE INVENTION

Throughout this description, the term "target" indicates a mark to shoot at. The target can be an object or surface in the real world, or it can be a region/direction in the real world that is not connected to a specific object (e.g., shooting direction). For example, a shooting direction acquisition (similar to a target lock) can be obtained using a firearm's trigger as a lock button or a dedicated button connected.

The present invention relates to a firearm trigger control device, which is adapted to control the displacement of a firearm's trigger (e.g., when the trigger is pressed by a user thereof), such as to enable the discharge of a projectile upon receiving a firing signal (e.g., at a timing determined as optimal for hitting a designated target).

According to an embodiment of the invention, the firearm trigger control device may restrict the trigger's displacement to a predetermined extent and releases it to complete its displacement and thus triggering a projectile discharged from the firearm upon receiving the firing signal, e.g., that may be originated from a smart aiming device.

The term "firearm" referred to herein should be read as a man-operated weapon designed to be aimed towards a target by its user and triggered to discharge a projectile (e.g., a bullet) by the user pressing the firearm's firing trigger. Furthermore, the term "trigger" is referred to herein should be read as a displaceable element, which is being displaced to a certain extent (e.g., by a firearm user or by an electronic trigger arrangement) and at a certain displacement point (e.g., at the end of that extent) from which further displacement of the displaceable element triggers a projectile discharged from the firearm.

In the following detailed description, references are made to the accompanying drawings that form a part hereof and are shown by way of illustrating specific embodiments or examples. These embodiments may be combined, other embodiments may be utilized, and other changes may be made without departing from the present invention's spirit or scope.

Figure 1A:
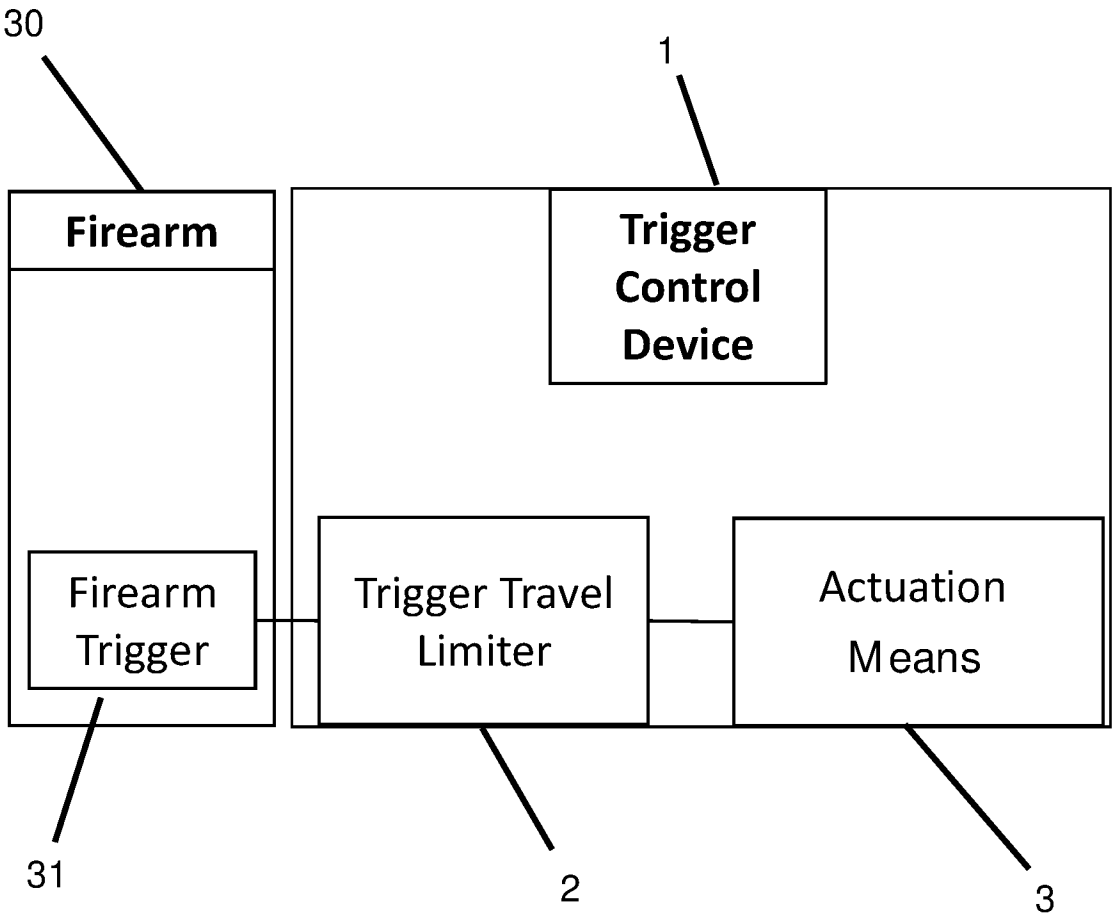
FIG. 1A schematically illustrates a firearm trigger control device, according to an embodiment of the present invention.

FIG. 1A schematically illustrates a firearm trigger control device 1, according to an embodiment of the present invention. Device 1 comprises a trigger travel limiter 2 and an actuation means 3 that drives/causes trigger travel limiter 2 to restrict the displacement of a trigger 31 of a firearm 30 to a predetermined extent and to release trigger 31 to continue the displacement until triggering a projectile discharged from firearm 30. The timing in which trigger travel limiter 2 releases trigger 31 may be determined correspondingly to the desired firing direction, based on which a firing signal is generated by either device 1 or an external source.

According to an embodiment of the invention, the firing signal can be implemented in different ways, including but not limited to a discrete line, message, or timestamp. It should be emphasized that the term "firing signal" does not imply any particular form. Therefore it might not be a per-se signal (usually understood as using a discrete line with "0" and "1" states). The invention applies to all suitable forms of a firing signal. For example, the firing signal can be a timestamp for firing timing that is transferred between an aiming device (e.g., such as smart aiming means 20 of FIG. 1B) and the actuation means.

Figure 1B:
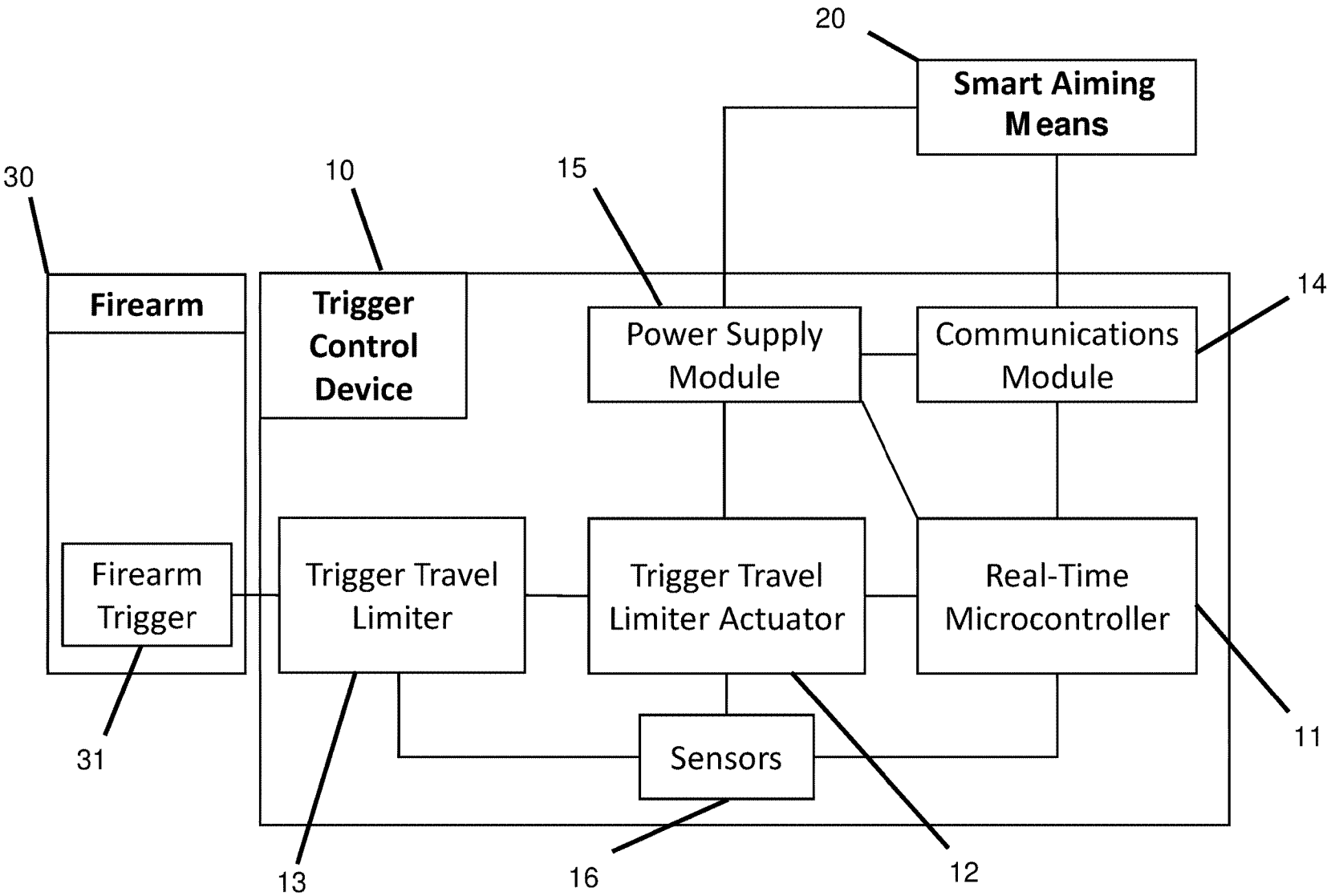
FIG. 1B schematically illustrates a firearm trigger control device, utilized in conjunction with a smart aiming means and a firearm, according to an embodiment of the present invention.

FIG. 1B schematically illustrates an exemplary configuration of a firearm trigger control device 10, utilized in conjunction with a smart aiming means 20 and a firearm 30, according to an embodiment of the present invention. Device 10 comprises a controller such as a real-time microcontroller 11, which is adapted to control a trigger travel limiter actuator 12, which actuates a trigger travel limiter 13, to restrict the extent to which a firearm trigger 31 travels (e.g., when being pressed by a user of firearm 30), and to release the firearm trigger 31 to complete its travel and thus to trigger a projectile discharged from firearm 30, upon receiving fire signal through a communication module 14 comprising wired/wireless communication means.

Smart aiming means 20 is a pointing aid that is configured to monitor and optionally display the position of a designated target (i.e., selected by the user of firearm 30 'locking' aiming means 20 on a determined target or region) with respect to the expected trajectory of a bullet that would have been instantly discharged from firearm 30. The smart aiming means may consider static and dynamic parameters such as the positioning and stability of firearm 30, the target range, ballistic calculations, wind velocity, etc., and thereby it may determine the optimal timing for a bullet to be discharged from firearm 30, that may have a high probability for hitting the designated target. One example of a smart aiming means 20 is an aiming system such as disclosed in U.S. Pat. No. 10,097,764.

Device 10 can be activated in different sequences, for example:

- Device 10 restricts the travel of trigger 31 upon a target is 'locked on' by aiming means 20, and releases upon receiving a firing signal from aiming means 20;
- Device 10 restricts the travel of trigger 31 only when both a target is 'locked on' by aiming means 20, and the firearm user starts pressing trigger 31, and releases upon receiving a firing signal from aiming means 20; or
- Device 10 restricts the travel of trigger 31 upon detecting when the firearm user starts pressing trigger 31, and releases upon receiving a firing signal from aiming means 20.

According to an embodiment of the present invention, the operation process of device 10 may involve the following procedure:

- Aiming means 20 'locks' one or more targets or a region (e.g., the lock can be initiated by the user or performed automatically by aiming means 20);
- Microcontroller 11 instructs travel limiter actuator 12 to actuate travel limiter 13 for restricting the travel of trigger 31 (e.g., to the extent at which further travel of a rifle's trigger releases the rifle's hammer/pin to knock the projectile's primer);
- The user is constantly pressing the trigger and aiming the firearm towards the designated target;
- Upon receiving a firing signal from aiming means 20 determining an optimal projectile discharge timing, microcontroller 11 instructs travel limiter actuator 12 to release travel limiter 13 to enable further travel of trigger 31, thereby discharging a projectile from firearm 30 at the optimal timing.

The required electric power for operating the components of device 10 is supplied by a power supply module 15 (e.g., comprising a rechargeable/disposable battery or being fed by an external power supply, such as installed in an aiming means 20, on the firearm or carried by the firearm's user).

Device 10 further comprises one or more sensors 16 that are suitable to provide data in accordance with the usage or states of the firearm on which device 10 is installed. For example, at least one of the sensors (e.g., hall sensors, acceleration sensors, etc.) can be used to detect trigger 31 engagement with trigger travel limiter 13, implying the user's intention to shoot a designated target, as well as the instant position of travel limiter actuator 12. The data collected from the reading of sensors 16 is sent to microcontroller 11, which accordingly controls the operation of travel limiter actuator 12. According to an embodiment of the present invention, data collected from sensors 16 can be submitted through the communication module 14 to aiming means 20 (e.g., for locking aiming means 20 on a designated target by detecting firearm 30 user press trigger 31 which engages travel limiter 13).

The use of sensors 16 can provide useful functions of device 10, such as closed-loop control of trigger limiter 13, shots counting, malfunction identification, and safety functionalities (e.g., preventing firing on an undesirable target when firing signal is not sent by aiming means 20). For example, a combination of gyro and accelerometer sensors (that can be used for detecting fire shock) and trigger position sensors, can be used to create an accurate shot counter, and provide an operator with feedback during training (for example, about proper trigger pressing), detecting weapon malfunction (by knowing that the weapon is not firing when the trigger is pressed), etc.

Device 10 of FIG. 1B is illustrated as being dependent on receiving a firing signal from an external source, such as aiming means 20, to release trigger 31 to complete its movement, thereby discharging a projectile from firearm 30 at the optimal timing. However, according to some embodiments, device 10 may independently determine the optimal timing for firing.

For example, microcontroller 11 utilizes sensors 16 (e.g., accelerometer sensor, gyroscope sensor, etc.) to acquire the instant location and posture of firearm 30 at the moment when the user starts pressing trigger 31 (e.g., the press is detected by pressure or displacement sensors attached to trigger 31), where this event is being captured as a 'target lock'. Whereas the optimal timing for firing (i.e., the hit probability of the 'target' is above a predetermined threshold) is determined by microcontroller 11 (e.g., when the firearm is nearest to the acquired 'target lock' location and posture), it instructs travel limiter actuator 12 to release travel limiter 13, thereby discharging a projectile from firearm 30.

One manner in which the displacement of trigger 31 can be controlled is by positioning a blocking means behind it, the displacement of which is controlled such as to restrict the travel of trigger 31 being pulled by a user's finger at the point at which further travel of trigger 31 operates the firearm's component which discharges a projectile.

For example, temporarily blocking the trigger of an armed rifle (i.e., in its armed state where the sear catches the hammer in a cocked position) at the point from which further displacement of the rifle's trigger forces the sear to release the cocked hammer for striking a loaded cartridge and discharging a bullet, whereas a firing signal is received from aiming means 20 (i.e., the optimal time for discharging a bullet) the blocking means is being moved to allow further displacement of the trigger, thus to discharge a bullet.

According to some embodiments of the present invention, the proposed trigger control device is installed in a firearm's existing/replacement grip handle (i.e., which is an essentially hollow enclosure located just behind the firearm's trigger in many cases), thus enabling a simple retrofit of the firearm to utilize the proposed device.

Figure 2:
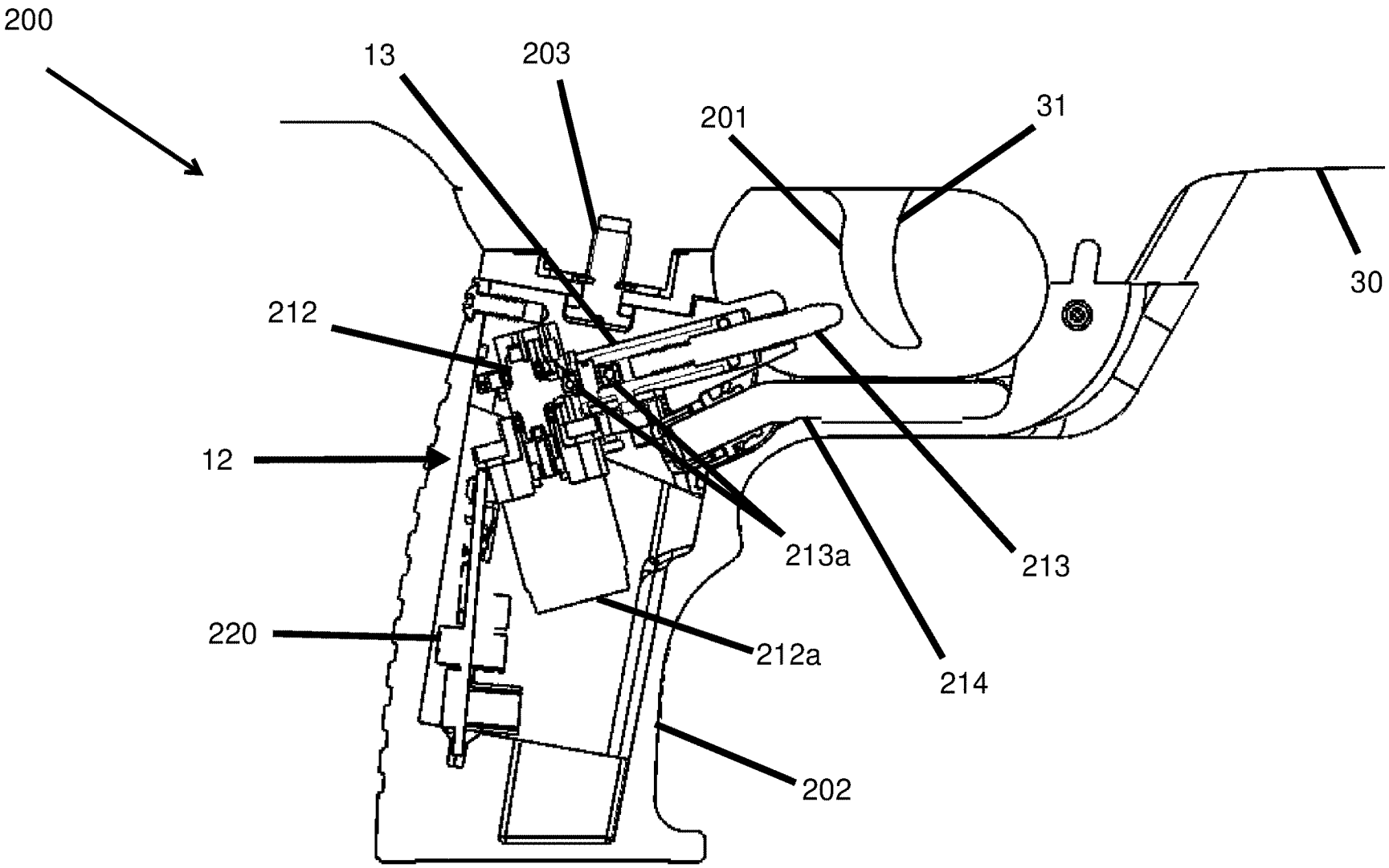
FIG. 2 schematically illustrates a firearm trigger control device installed with a firearm, according to an embodiment of the present invention.

FIG. 2 schematically illustrates a firearm trigger control device 200 installed with a firearm 30, according to an embodiment of the present invention. For the sake of clarity, FIG. 2 illustrates only the operable section of firearm 30 comprising its trigger 31 and grip handle. Device 200 comprises a replacement grip handle 202 that is essentially designed similarly to the original grip handle of firearm 30 and may comprise similar attachment means to firearm 30, e.g., such as bolts 203 and corresponding drills. Grip handle 202 may accommodate travel limiter actuator 12, travel limiter 13, and circuitry 220 in which electrical/electronic components of device 200 are integrated (e.g., microcontroller 11, communication module 14, and power supply module 15 of FIG. 1). FIG. 2 further illustrates a connection wire 214 of communication module 14, and connection device 200 to aiming means 20 (not shown).

Figure 3A:
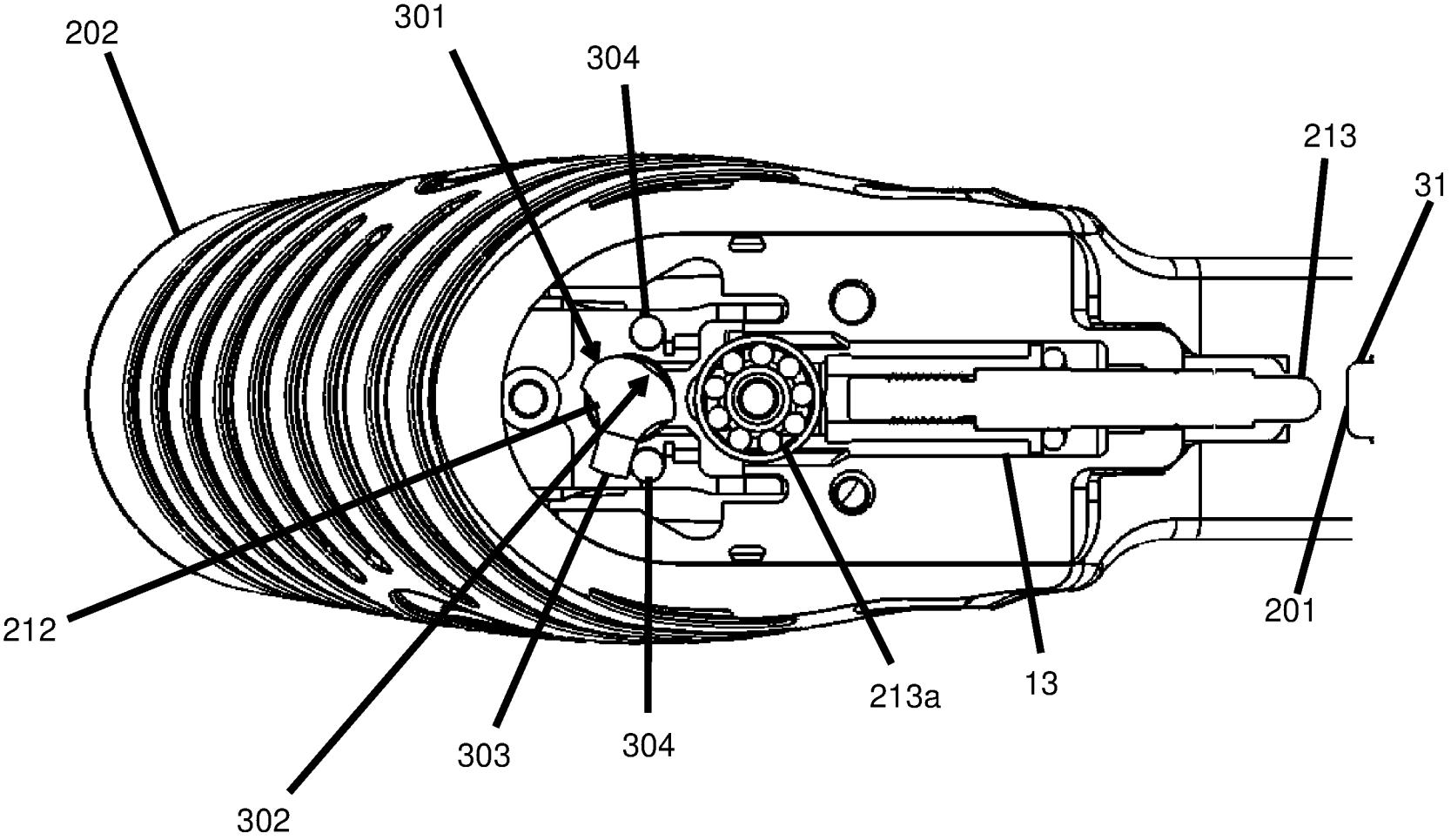
FIGS. 3A-3C schematically illustrates a top view of the device of FIG. 2 in idle, blocking, and firing states.
Figure 3B:
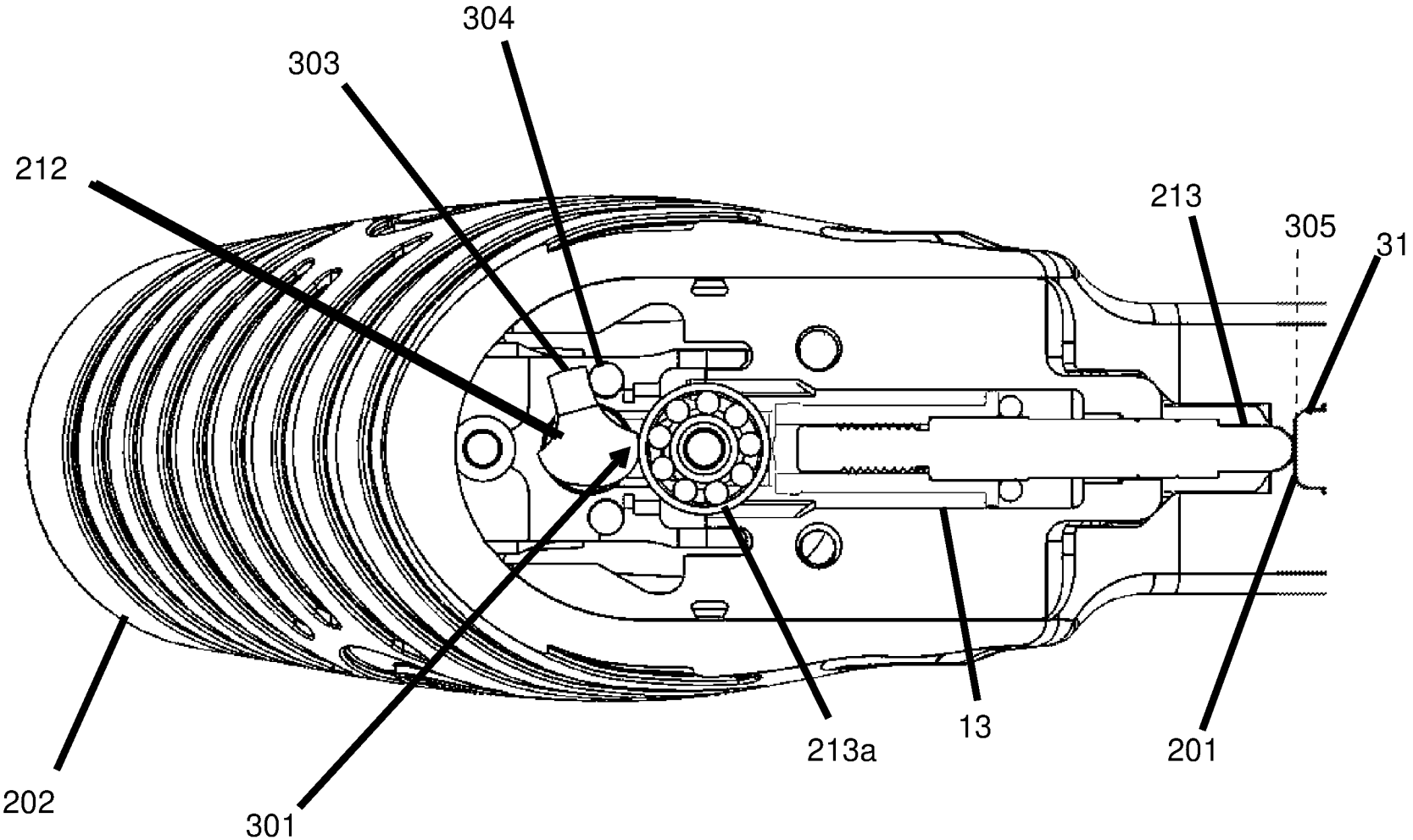
Figure 3C:
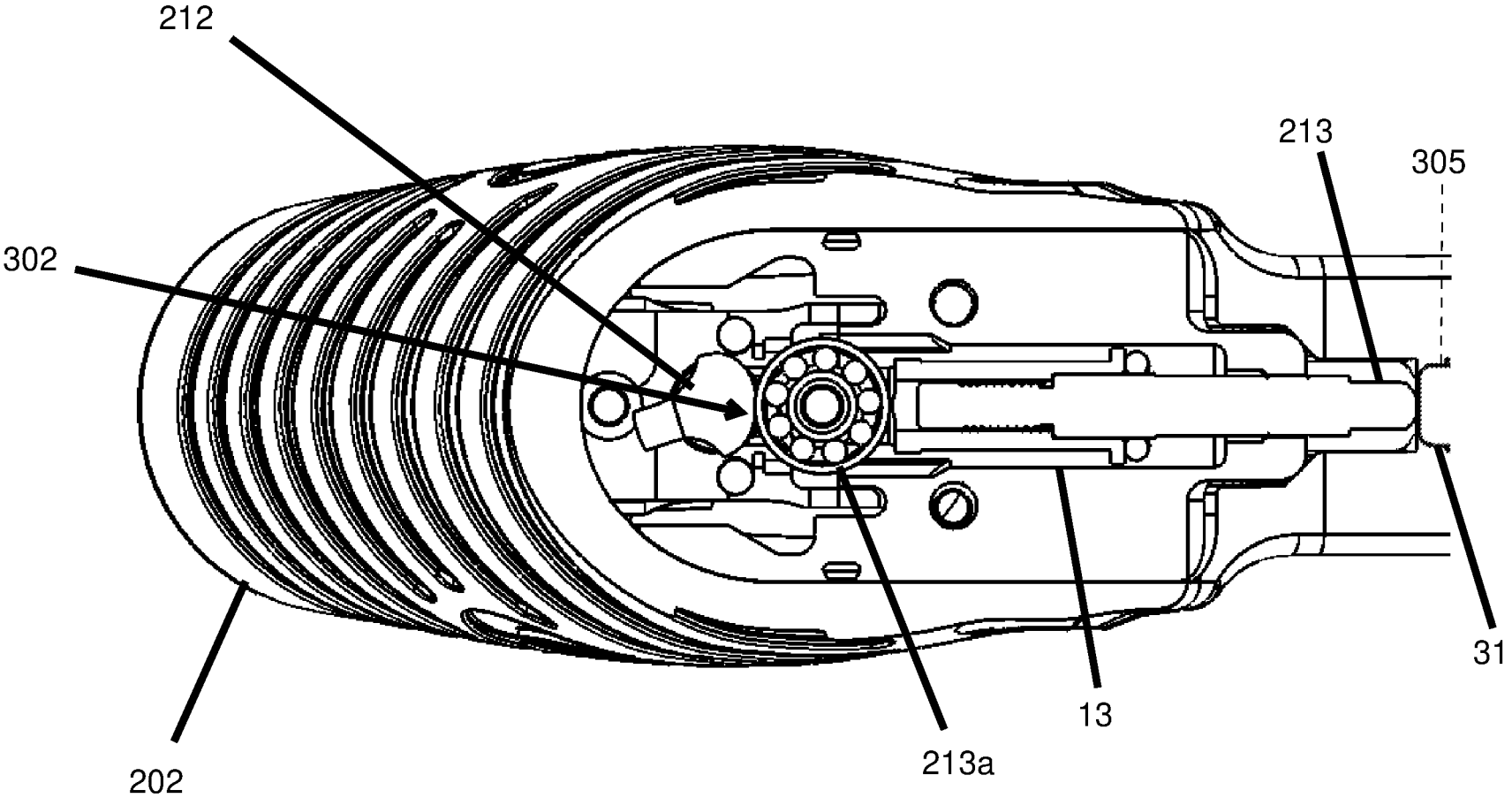

Travel limiter actuator 12 of FIG. 2 comprises a rotatable camshaft actuator 212 having variating radial protrusions/depressions, which interfaces with a bearing 213*a* hinged to the rear portion of travel limiter 13, where the controlled rotation of camshaft actuator 212 (i.e., by microcontroller 11 controlling the current supplied to a rotation motor 212*a* by power supply 15), enables to introduce different protrusion/depression to bearing 213*a*, thus to control the axial movement of travel limiter 13, and hence the extent to which a blocking element of limiter 13 (e.g., in the form of a pin, an arm, etc.) such as a pin 213 threaded at the front portion of travel limiter 13 protrudes behind trigger 31, thereby to restrict or release the displacement of trigger 31 (further illustrated in FIGS. 3A-3C).

The rollable interface between camshaft actuator 212 and bearing 213*a* enables reduced loading of the interface therebetween, regardless of the pressure applied on trigger 31 by the user's finger. Furthermore, the protrusions/depressions of camshaft actuator 212 can be shaped with suitable inclinations to determine the speed at which travel limiter 13 and trigger 31 continue their displacement backwardly upon receiving the 'firing signal'. Moreover, the rotation speed of motor 212*a* can be adjusted for the same purpose, providing precise control of trigger 31.

Blocking pin 213 is threaded into travel limiter 13, thus enabling adjustment of its protrusion with respect to the rear portion 201 of trigger 31, thereby enabling adaption of device 200 to multiple different firearm designs. This design enables calibrating the exact point at which limiter 13 restricts trigger 31, e.g., in accordance with various sear-hammer latching configurations, that can vary between different firearm designs and due to manufacturing tolerances of the weapon, its condition, etc.

According to an embodiment of the invention, the adjustment mechanism of blocking pin 213 can be implemented by allowing blocking pin 213 to be rotated in and out of travel limiter 13, similar to a screw. Such an adjustment mechanism can be further enhanced by implementing a 'push-to-rotate' mechanism that only allows the pin to be rotated when pushed into travel limiter 13 (for example, by several millimeters). Such an enhancement helps avoid accidental rotation of the blocking pin 213 in field situations.

As illustrated in FIG. 2, multiple different types of firearms can be retrofitted with device 200 without requiring a trigger mechanism or other internal structural modifications.

One skilled in the art will readily recognize multiple different actuation arrangements of travel limiter 13 by electromagnetic/hydraulic/pneumatic/solenoid/piezoelectric actuators 12, similarly employed for controlling travel limiter 13 with respect to trigger 31, in a fast and repetitive manner, suitable to operate in the narrow discharging time window.

According to an embodiment of the invention, device 200 is provided with seal means, such as an O-ring installed between pin 213 and travel limiter 13, which prevents penetration of water or solid particles into the mechanism, when the blocking pin 213 is pressed (by either trigger 31 during shooting or by the user during calibration described above.

FIG. 3A schematically illustrates a top view of device 200 in an idle state, according to an embodiment of the present invention. In this idle state, trigger 31 is un-pressed, and its rear portion 201 does not interface with blocking pin 213; thus, bearing 213*a* is not in communication with camshaft 212.

Further shown in FIG. 3A are a blocking state protrusion 301 and firing depression 302 of camshaft 212, as well as a limiter protrusion 303 thereof, which is utilized for restricting the rotation of camshaft 212 by limited travel of limiter protrusion 303 between two stoppers 304, while shifting device 200 between the idle state of FIG. 3A, a blocking state of FIG. 3B and a firing state of FIG. 3C.

According to an embodiment of the present invention, camshaft 212 further comprises a returning spring (not shown), for forcing camshaft 212 to its idle state, which can be configured as the default state of device 200, and is also useful in a case of a fault in device 200, such as to allow a manual operation of firearm 30 unaffected by device 200.

FIG. 3B schematically illustrates a top view of device 200 in a blocking state, according to an embodiment of the present invention, in which trigger 31 is pressed by a user of firearm 30 to travel rearwardly such as that rear portion 201 engages pin 213, pushing travel limiter 13 rearwardly, thus bearing 213*a* interfaces with blocking state protrusion 301 of camshaft 212 (i.e., microcontroller 11 operates motor 212*a* to rotate camshaft 212 to turn and hold protrusion 301 to face bearing 213*a*), thus blocking travel limiter 13 from further traveling rearwardly, and hence, rear portion 201 from passing the firing threshold line 305. The actual location of line 305 is determined by the trigger mechanism structure and its corresponding geometry, which defines the firing point. Further rearward displacement of trigger 31 activates the sear-hammer arrangement, resulting in a bullet discharged from firearm 30.

FIG. 3B schematically illustrates a top view of device 200 in a blocking state, according to an embodiment of the present invention, in which trigger 31 is pressed FIG. 3C schematically illustrates a firearm trigger control device 200 in an idle state, according to an embodiment of the present invention, in which microcontroller 11 (of FIG. 1) operates motor 212*a* (FIG. 2) to further rotate camshaft 212, turning firing depression 302 to face bearing 213*a*, allowing further rearward travel of travel limiter 13, thus further rearward travel of trigger 31, resulting with bullet discharge from firearm 30.

Of course, while camshaft 212 of FIG. 3A-3C is illustrated as having a specific peripheral contour, alternate contours can be selected by one skilled in the art for specific applications and due to various considerations, for example, choosing a steeper depression 302 with respect to protrusion 301 for enabling a shorter transition from a blocking state (FIG. 3B) to a firing state (FIG. 3C).

Furthermore, different actuation arrangements can be selected, such as employing a rotatable blocking camshaft disc (not shown) in lieu of the axially extending/retracting blocking pin 213.

Moreover, while device 200 is illustrated as being installed externally to the trigger mechanism, according to some embodiments, device 10 of FIG. 1B can be readily realized as a built-in module integrated with a new/retrofitted firearm, enabling minimal interference to the original design of the firearm. For example, in cases where the firearm's grip handle is not hollow or is utilized for different uses (e.g., handguns or weapons with non-detachable grip).

Figure 4:
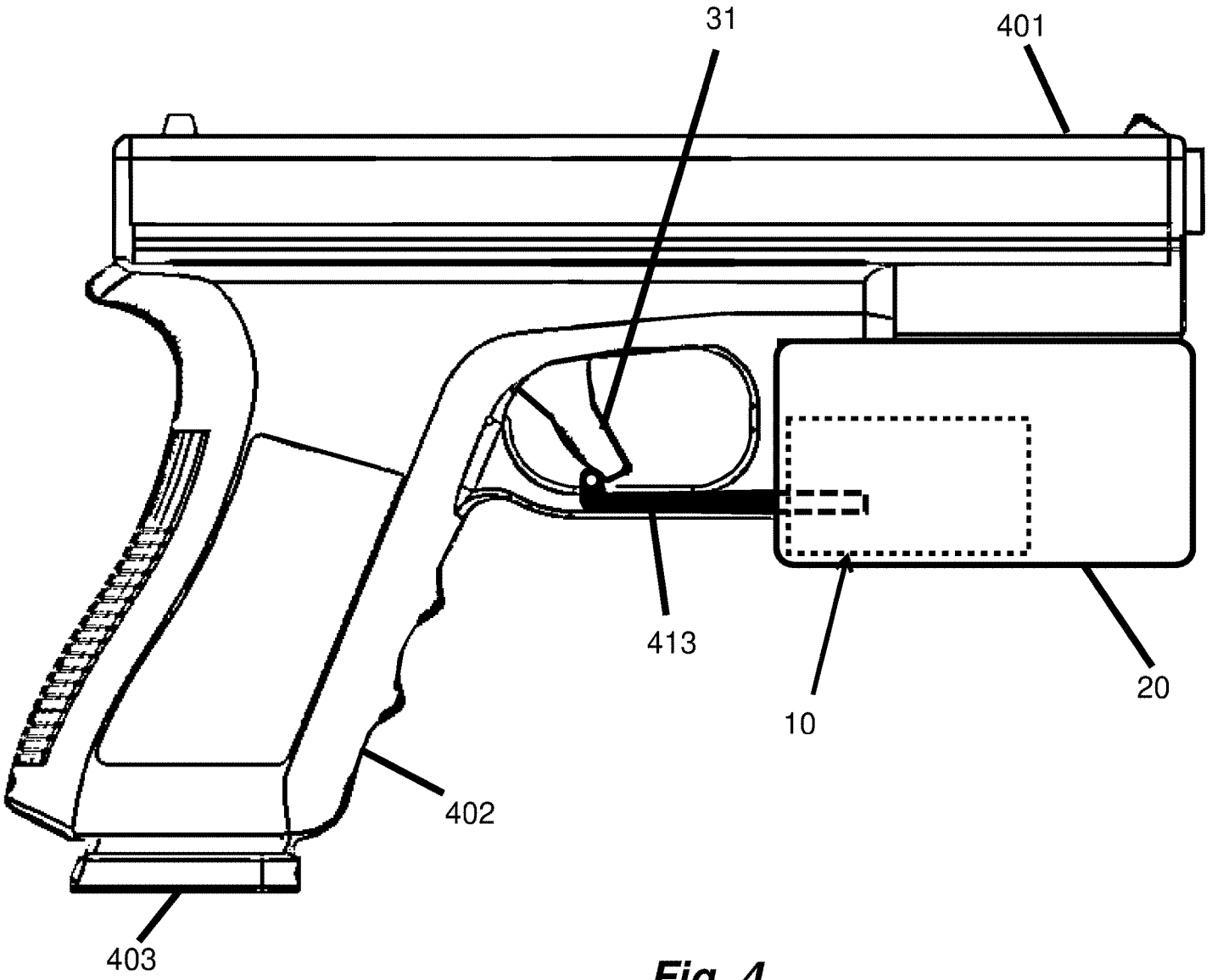
FIG. 4 schematically illustrates a firearm provided with a firearm trigger control device installed in front of the firearm's trigger, according to another embodiment of the present invention.

FIG. 4 schematically illustrates a handgun 401 provided with a firearm trigger control device 10 installed in front of the firearm's trigger 31, according to another embodiment of the present invention. In this embodiment, device 10 is integrated within an aiming means 20 (as schematically indicated by the dotted form in the figure). As shown in the figure, aiming means 20 is installed in front of trigger 31 (e.g., below the barrel of handgun 401, as in this specific handgun 401 grip handle 402 is accommodated by a magazine 403). In this embodiment, the blocking travel limiter is in the form of a blocking arm 413 that extends rearwardly to interface the rear portion of trigger 31. In this embodiment, the distal end of blocking arm 413 is adapted to restrict the rear lower portion of trigger 31 (i.e., in a similar operation manner as blocking pin 213 of FIG. 2), such as to control the displacement of trigger 31 as described hereinabove with respect to FIGS. 1-3.

Although embodiments of the invention have been described by way of illustration, it will be understood that the invention may be carried out with many variations, modifications, and adaptations, without exceeding the scope of the claims.

The invention claimed is:

1. A firearm trigger control device, comprising: a trigger travel limiter and an actuation means that drives/causes the trigger travel limiter to restrict the displacement of a trigger of the firearm to a predetermined extent and to release said trigger to continue the displacement until triggering a projectile discharged from said firearm, wherein a timing for releasing said trigger travel limiter releases said trigger corresponds to the occurrence of a firing signal received from a controlling system indicating that the release of a bullet will hit a designated target with high probability, wherein the trigger travel limiter comprises a bearing hinged to its rear portion, wherein said bearing is in a rolling interface with the actuation means.

2. A device according to claim 1, further comprises a controller that controls the actuation means that drives the trigger travel limiter to control its motion with respect to the firearm's trigger.

3. A device according to claim 1, wherein the timing is determined by a firing signal received from an external source.

4. A device according to claim 3, in which the external source is a smart aiming system that is configured to provide a firing signal.

5. A device according to claim 3, further comprises a controller configured to control said actuation means of the trigger travel, based on said received firing signal of said external source.

6. A device according to claim 5, further comprises sensors suitable for providing data in accordance with a usage or state of the firearm, wherein said sensors are used for one or more of the following: maintenance, safety, control, shot counting, and malfunction identification purposes.

7. A device according to claim 1, in which the actuation means comprises an actuator selected from a group of actuators functionally adapted to convert energy into mechanical motion to drive the trigger travel limiter, the group consisting of: electromagnetic, hydraulic, pneumatic, solenoid, and piezoelectric actuator.

8. A device according to claim 1, in which the actuation means is a rotatable camshaft actuator having variating radial protrusions and depressions being controllably rotated by a motor.

9. A device according to claim 1, in which the trigger travel limiter comprises a blocking element that interfaces with the firearm's trigger.

10. A device according to claim 1, further comprises one or more sensors suitable for providing data in accordance with a usage or state of the firearm.

11. A device according to claim 10, in which the one or more sensors are selected from a group of sensors adapted to detect physical properties relevant to the firearm's usage state, the group consisting of: hall sensors, gyroscope sensors, acceleration sensors, pressure sensors, or any combination thereof.

12. A device according to claim 10, further comprises a controller, wherein the controller utilizes data from the one or more sensors to acquire the desired direction of fire and to provide a firing signal based on said optimal timing for discharging a projectile toward a target.

13. A device according to claim 10, wherein said device is adapted to detect an initial press on the firearm's trigger for determining the desired direction of fire.

14. A device according to claim 1, in which said device is installed within an existing firearm grip handle.

15. A device according to claim 14, in which said device is installed within a dedicated grip handle, replacing the firearm's original grip handle.

16. A device according to claim 1, in which said device is a built-in module integrated with the firearm.

17. A device according to claim 1, in which said device is installed in front of the trigger of the firearm.

* * * * *